US006860750B1

(12) United States Patent
Wu

(10) Patent No.: US 6,860,750 B1
(45) Date of Patent: Mar. 1, 2005

(54) CABLE END CONNECTOR ASSEMBLY HAVING LOCKING MEMBER

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/728,614

(22) Filed: Dec. 5, 2003

(51) Int. Cl.[7] ..... H01R 13/627
(52) U.S. Cl. ..... 439/358; 439/357; 439/607
(58) Field of Search ..... 439/352–358, 439/607–610

(56) References Cited

U.S. PATENT DOCUMENTS 5,660,558 A * 8/1997 Osanai et al. ..... 439/353
6,039,606 A * 3/2000 Chiou ..... 439/610
6,454,577 B1 * 9/2002 Yi ..... 439/108
6,565,383 B1 5/2003 Wu ..... 439/567
6,585,536 B1 7/2003 Wu ..... 439/358
6,585,537 B1 7/2003 Lee ..... 439/357

* cited by examiner

*Primary Examiner*—Michael C. Zarroli
(74) *Attorney, Agent, or Firm*—Wei Te Chung

(57) ABSTRACT

A cable end connector assembly (10) for mating with a complementary connector (20) includes an insulative housing (12), a number of contacts (130) received in the insulative housing, a spacer (13) mounted to a rear end of the insulative housing, a cable (14) including a number of conductors (140) electrically connecting with corresponding contacts, a cover (15) over-molded with the insulative housing and the cable, and a locking member (16). The housing forms a pair of wing portions (129) extending rearwardly therefrom. The cover defines a pair of passages (151) to receive the wing portions. The locking member includes a retaining section (160) secured with the insulative housing, a pushing section (162) engaged with the pair of wing portions, and a pair of latch portions (1610) located close to the retaining section.

16 Claims, 12 Drawing Sheets

CABLE END CONNECTOR ASSEMBLY HAVING LOCKING MEMBER

CROSS-REFERENCE TO RELATED APPLICATIONS

This application is related to U.S. patent application Ser. No. 10/660,315 filed on Sep. 10, 2003 and entitled "CABLE END CONNECTOR ASSEMBLY WITH LOCKING MEMBER", Ser. No. 10/665,060 filed on Sep. 17, 2003 and entitled "CABLE END CONNECTOR ASSEMBLY HAVING LOCKING MEMBER", both of which are invented by the same inventor and assigned to the same assignee as this application.

BACKGROUND OF THE INVENTION

1. Field of the Invention

The present invention relates to a cable end connector assembly, and particularly to a cable end connector assembly having a locking member for locking with a complementary connector.

2. Description of Related Art

There exists in the art an electrical connector known as a Serial Advanced Technology Attachment (Serial ATA) connector which is generally used for disk drives and storage peripherals. Especially, the Serial ATA connectors according to the Serial ATA standard are featured in fewer electrical contacts than other conventional electrical connectors and are relatively tiny in configuration. It is desirable for the Serial ATA connector to have latch means for providing a reliable mechanical and electrical connection with a complementary connector. U.S. Pat. Nos. 6,565,383 and 6,585,536, having the same inventor and the same assignee with the present invention, each disclose a Serial ATA connector equipped with a locking member for locking with a complementary connector. The locking member comprises a middle portion retained on a connector housing, a pushing portion extending rearwardly from the middle portion, and a locking portion extending forwardly from the middle portion for locking/releasing the Serial ATA connector with/from the complementary connector.

However, since the middle portion of the locking member is retained on the connector housing, the distance between a locking position and a releasing position of the locking portion is relatively small, thereby adversely affecting the engagement and disengagement between the Serial ATA connector and the complementary connector.

Hence, a cable end connector assembly having an improved locking member is desired.

SUMMARY OF THE INVENTION

An object of the present invention is to provide a cable end connector assembly having an improved locking member for locking the cable end connector assembly with a complementary connector.

To achieve the above object, a cable end connector assembly in accordance with the present invention comprises an insulative housing, a plurality of contacts received in the insulative housing, a spacer mounted to a rear end of the insulative housing, a cable comprising a plurality of conductors electrically connecting with corresponding contacts, a cover over-molded with the insulative housing and the cable, and a locking member. The housing forms a pair of wing portions extending rearwardly therefrom, and the cover defines a pair of passages to receive the wing portions. The locking member comprises a retaining section secured with the insulative housing, a locking section extending rearwardly from the retaining section. The locking section comprises a pushing section engaged with the wing portions of the insulative housing and a pair of latch portions located close to the retaining section for locking with the complementary connector.

Other objects, advantages and novel features of the invention will become more apparent from the following detailed description when taken in conjunction with the accompanying drawings.

DETAILED DESCRIPTION OF THE INVENTION

Figure 1:
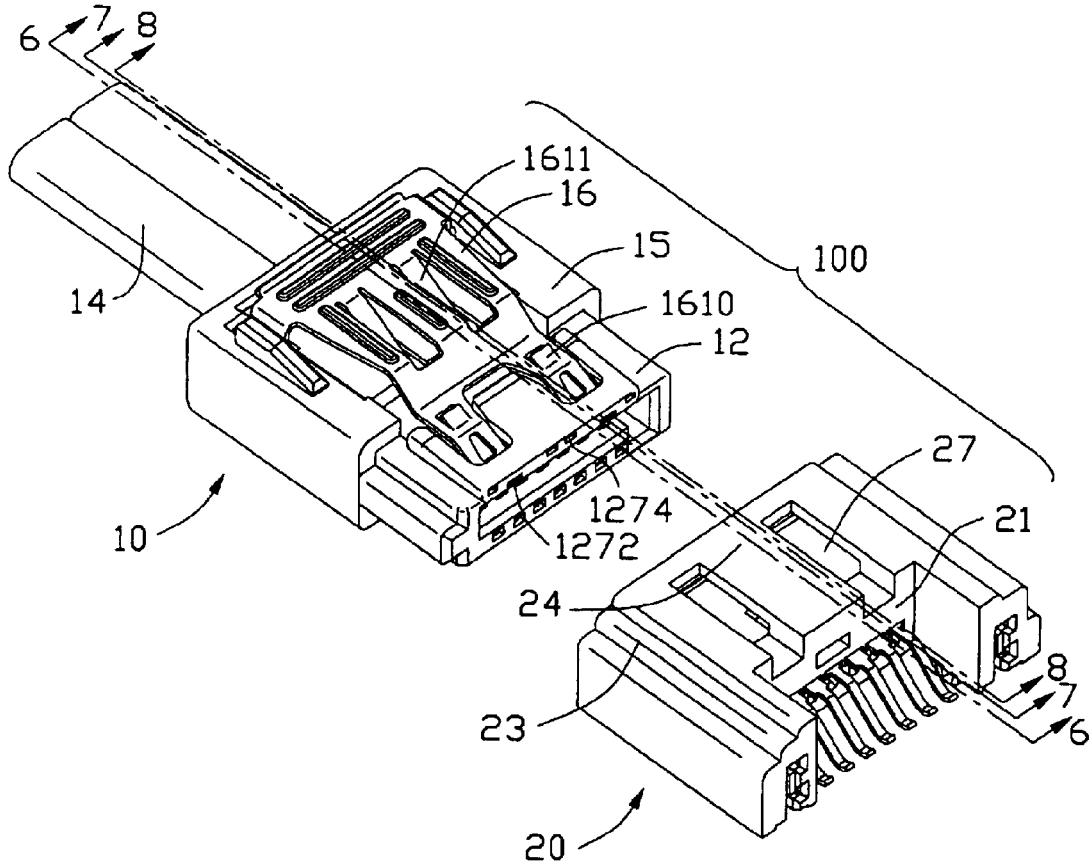
FIG. 1 is a perspective view of an electrical connector assembly comprising a cable end connector assembly in accordance with the present invention and a complementary connector.
Figure 2:
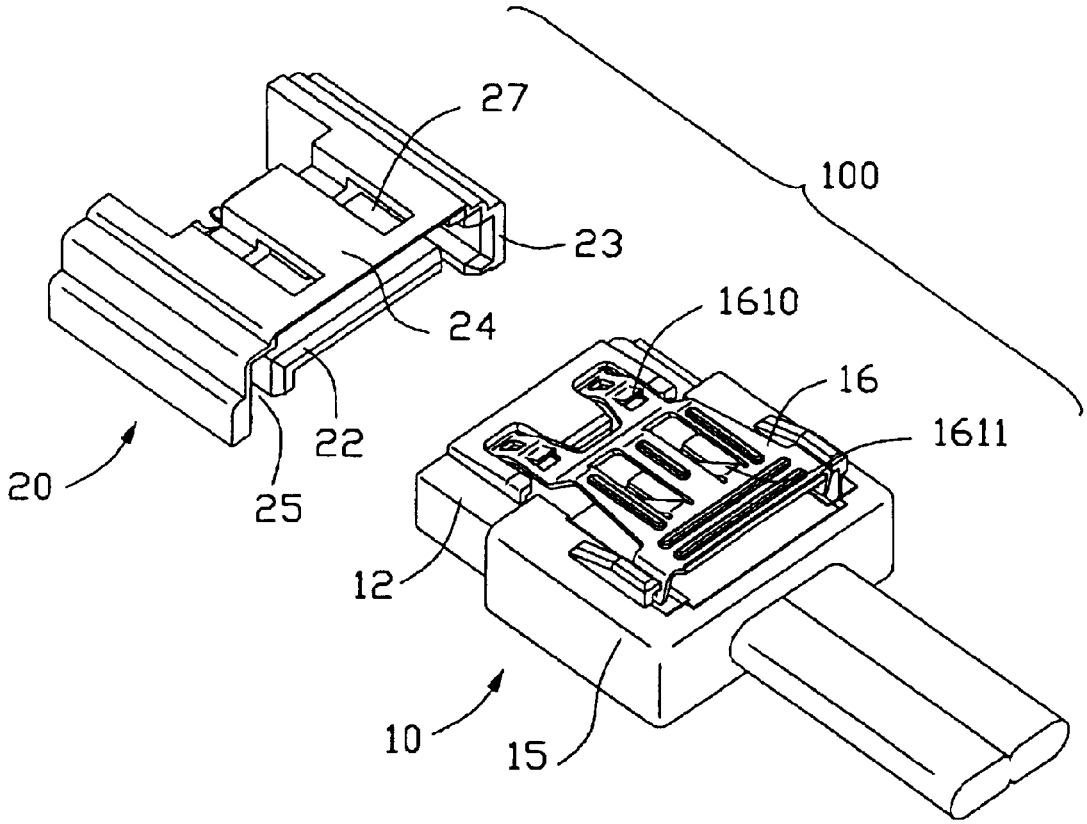
FIG. 2 is a view similar to FIG. 1, but taken from a different aspect.
Figure 3:
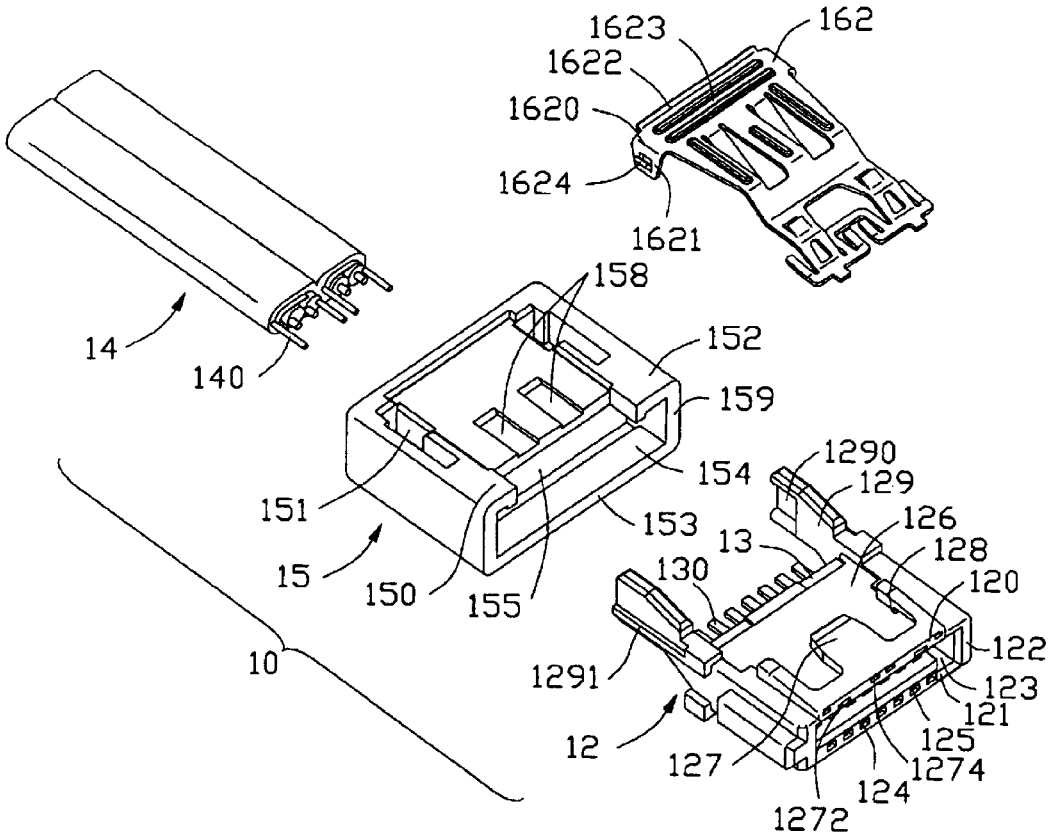
FIG. 3 is an exploded, perspective view of the cable end connector assembly of FIG. 1.
Figure 4:
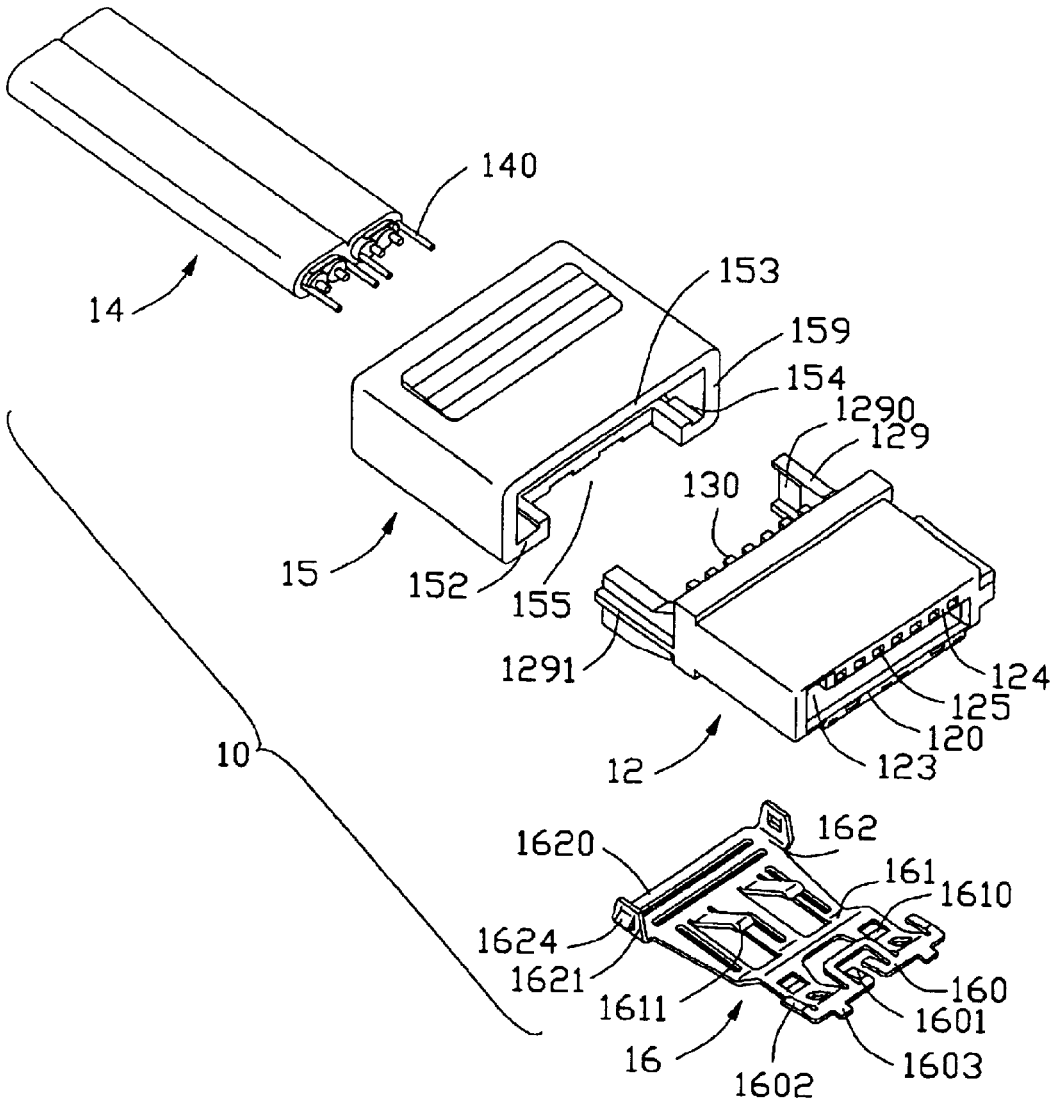
FIG. 4 is a view similar to FIG. 3, but taken from a different aspect.

Referring to FIGS. 1 and 2, an electrical connector assembly 100 comprises a cable end connector assembly 10 in accordance with the present invention and a complementary connector 20. In a preferred embodiment, the cable end connector assembly 10 and the complementary connector 20 are typical Serial ATA connectors. However, in alternative embodiments, the electrical connectors could be provided as other types.

Figure 5:
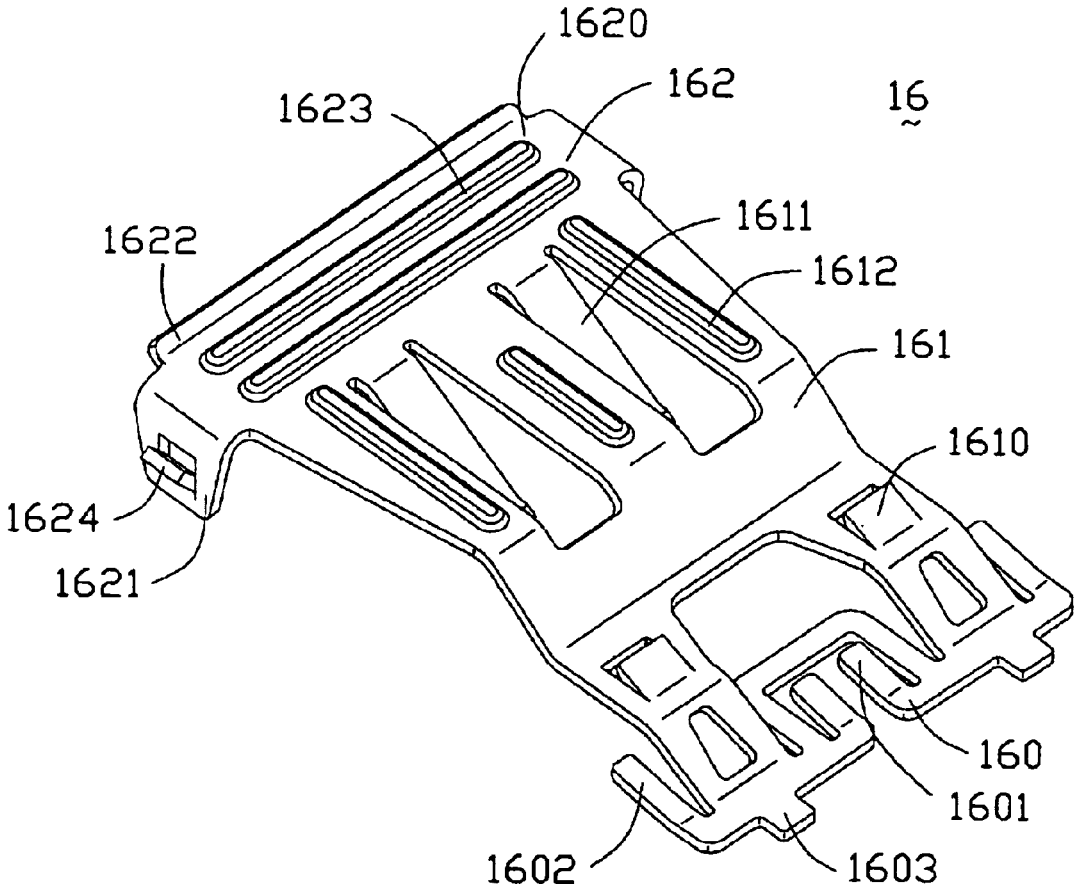
FIG. 5 is an enlarged view of a locking member shown in FIG. 3.
Figure 6:
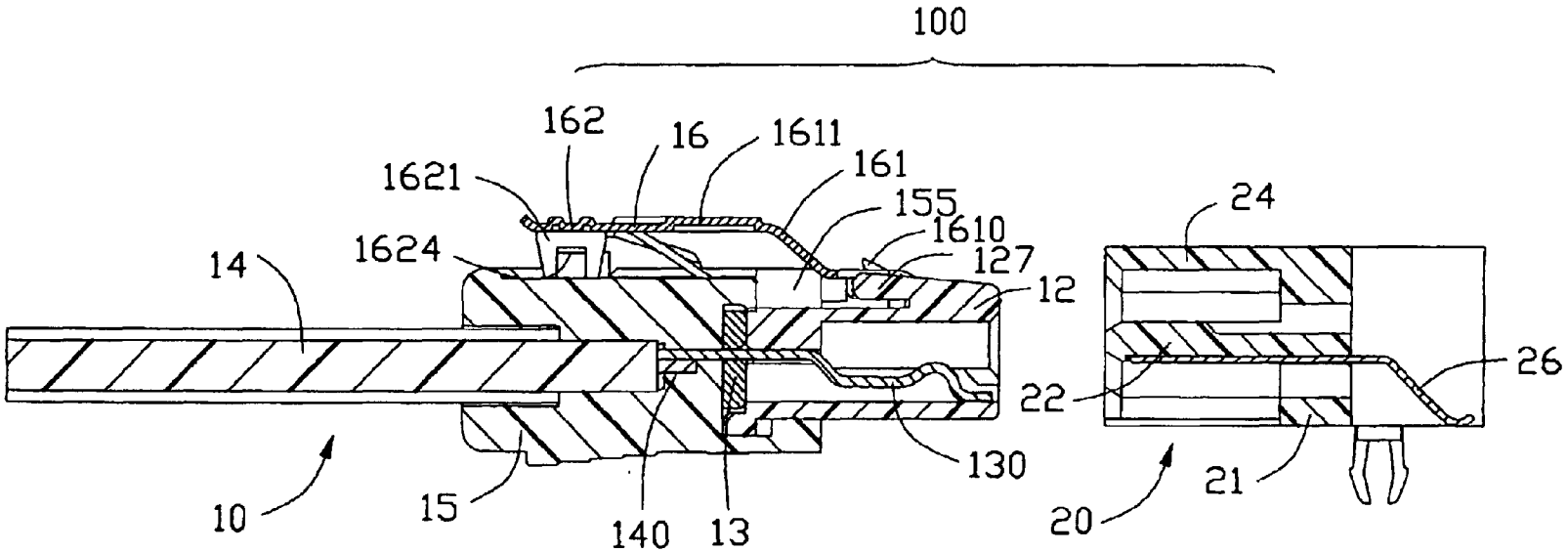
FIG. 6 is a cross-sectional view taken along line 6—6 of FIG. 1.
Figure 7:
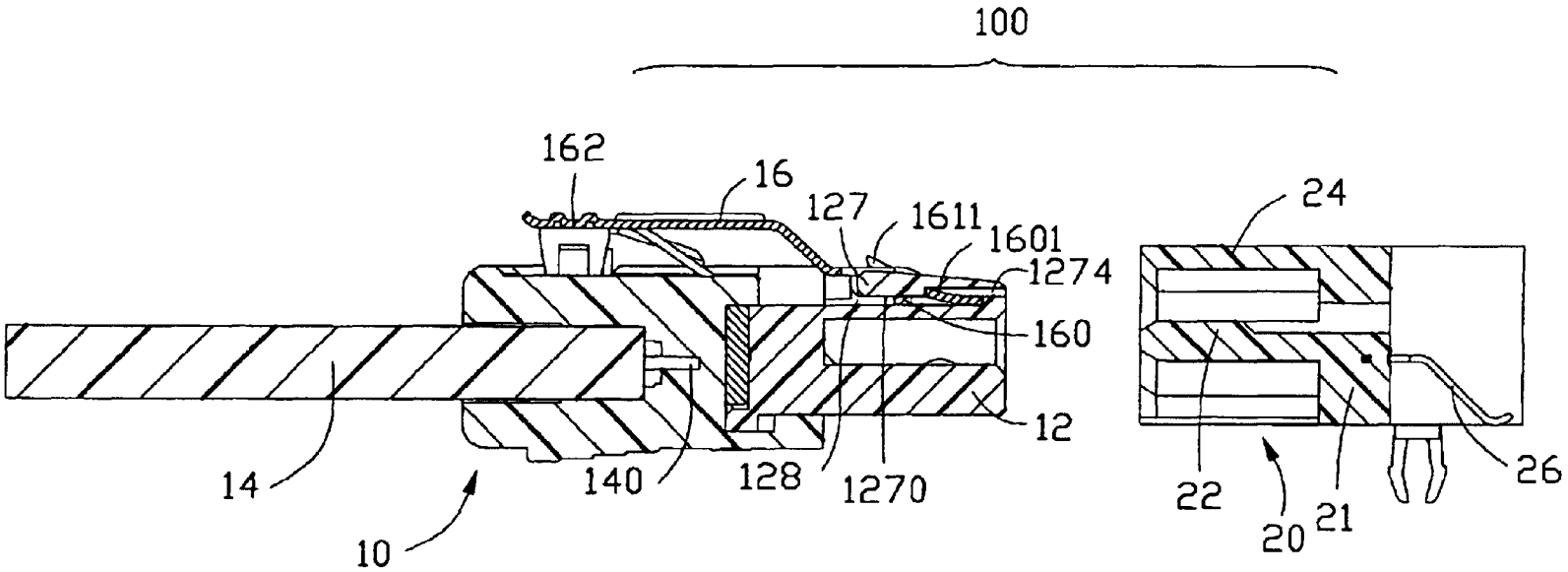
FIG. 7 is a cross-sectional view taken along line 7—7 of FIG. 1.

Referring to FIGS. 3–9, the cable end connector assembly 10 comprises an insulative housing 12, a plurality of contacts 130, a spacer 13, a cable 14, a cover 15 and a locking member 16. The insulative housing 12 comprises an upper wall 120, a lower wall 121 opposite to the upper wall 120, and a pair of sidewalls 122 connecting with the upper wall 120, the lower wall 121 and the sidewalls 122. An L-shaped receiving space 123 is defined between the upper and the lower walls 120, 121. A block 124 is formed on the lower wall 121 and protrudes into the receiving space 123. The block 124 defines a plurality of passageways 125 extending therethrough. The upper wall 120 defines a depression 126 on an upper surface thereof. A flat portion 127 extends rearwardly from a middle portion of a front flange of the upper wall 120 into the depression 126. A slit 1270 (FIG. 7)

is formed between the flat portion 127 and a bottom surface of the depression 126. The upper wall 120 defines a pair of grooves 128 extending along opposite inner sides of the depression 126. A pair of first slots 1272 and a pair of second slots 1274 extend rearwardly from a front face of the upper wall 120 into the flat portion 127 and communicate with the slit 1270, respectively. A pair of wing portions 129 respectively extend rearwardly from the sidewalls 122. Each wing portion 129 defines a cutout 1290 in an inner surface thereof and forms a guiding protrusion 1291 on an opposite outer surface thereof.

The contacts 130 are received in the passageways 125 of the insulative housing 12 with tail portions (not labeled) thereof extending rearwardly beyond a rear face of the insulative housing 12. The spacer 13 is mounted to a rear end of the insulative housing 12 and defines a plurality of through holes (not labeled) for allowing the tail portions of the contacts 130 extending therethrough. The spacer 13 can prevent plastic from entering into the passageways 125 of the insulative housing 12 during the molding of the cover 15. The contacts 130 and the spacer 13 can be integrally formed before mounting to the insulative housing 12, if desired.

The cable 14 comprises a plurality of conductors 140 exposed outside.

The cover 15 is over-molded with the insulative housing 12 and the cable 14 and comprises a rectangular body portion 150. The body portion 150 comprises an upper plate 152, a lower plate 153 opposite to the upper plate 152, and a pair of side plates 159 connecting with the upper plate 152, the lower plate 153 and the side plates 159. A receiving cavity 154 is defined between the upper and the lower plates 152, 153 for receiving a rear end of the insulative housing 12. The upper plate 152 defines a cutout 155 in a front end thereof and a pair of passages 151 in a rear end thereof communicating with the receiving cavity 154. Each passage 151 has a relatively smaller size in a front portion and a relatively bigger size in a rear portion. The upper plate 152 defines a pair of channels 158 communicating with the cutout 155.

Particularly referring to FIG. 5, the locking member 16 is stamped and formed from a metallic plate and comprises a retaining section 160, a locking section 161 extending upwardly and rearwardly from the retaining section 160. The retaining section 160 has a bar portion 1602 extending rearwardly from opposite ends thereof, a pair of snap portions 1601 extending upwardly and rearwardly from a middle portion of a front end thereof and a pair of positioning portions 1603 extending forwardly from the front end thereof. The locking section 161 comprises a pair of latch portions 1610 extending upwardly and rearwardly from a front portion thereof, a pair of lower tabs 1611 extending downwardly and forwardly from a rear portion thereof, and a pushing section 162 formed on the rear portion thereof. A plurality of ribs 1612 is respectively formed between and beside the pair of lower tabs 1611. The pushing section 162 comprises a body portion 1620, a pair of side beams 1621 extending downwardly from opposite ends of the body portion 1620, and a bent portion 1622 extending upwardly from a rear end of the body portion 1620. Each side beam 1621 is stamped with a spring tab 1624 extending outwardly therefrom. The body portion 1620 is formed with a plurality of ribs 1623 for facilitating handling. The bent portion 1622 and the ribs 1623 increase mechanical strength of the body portion 1620 to prevent the body portion 1620 from deforming.

Referring to FIGS. 1, 2 and 6–9, in assembly, the conductors 140 of the cable 14 are first soldered to the tail portions of the contacts 130, which are exposed outside the insulative housing 12. The cover 15 is over-molded with the rear end of the insulative housing 12 and the front end of the cable 14. The cutout 155 of the cover 15 communicates with the depression 126 of the insulative housing 12. The guiding projections 1291 of the wing portions 129 are respectively received in side channels 1510 communicating with the passages 151 to increasing a retaining force between the cover 15 and the housing 12. The wing portions 129 are partially exposed beyond the passages 151. The wing portion 129 abuts against a front edge of the passage 151 for preventing the wing portion 129 from escaping the passage 151. The locking member 16 is then assembled to the insulative housing 12 and the cover 15 with the bar portions 1602 received in the grooves 128 of the insulative housing 12. The middle portion of the retaining portion 160 is received in the slit 1270 with the positioning portions 1603 and the snap portions 1601 respectively locked with the first and the second slots 1272, 1374 to prevent the locking member 16 from moving rearwardly when the cable end connector assembly 10 mates with the complementary connector 20. The lower tabs 1611 are received in the channels 158 of the cover 15 and abut against bottom surfaces of the channels 158. The pushing section 162 moves downwardly to partially enclose the rear portion 151 of the cover 15 with the side beams 1621 respectively received in the cutouts 1290 of the wing portions 129 of the housing 12. The spring tabs 1624 elastically engage with inner surfaces of the cutouts 1290 for preventing the locking member 16 from escaping the cutouts 1290 of the housing 12. The pushing section 162 is downwardly movable relative to the rear portion 151 of the cover 15 to deflect the locking section 161 toward the cover 15 and the insulative housing 12.

Figure 8:
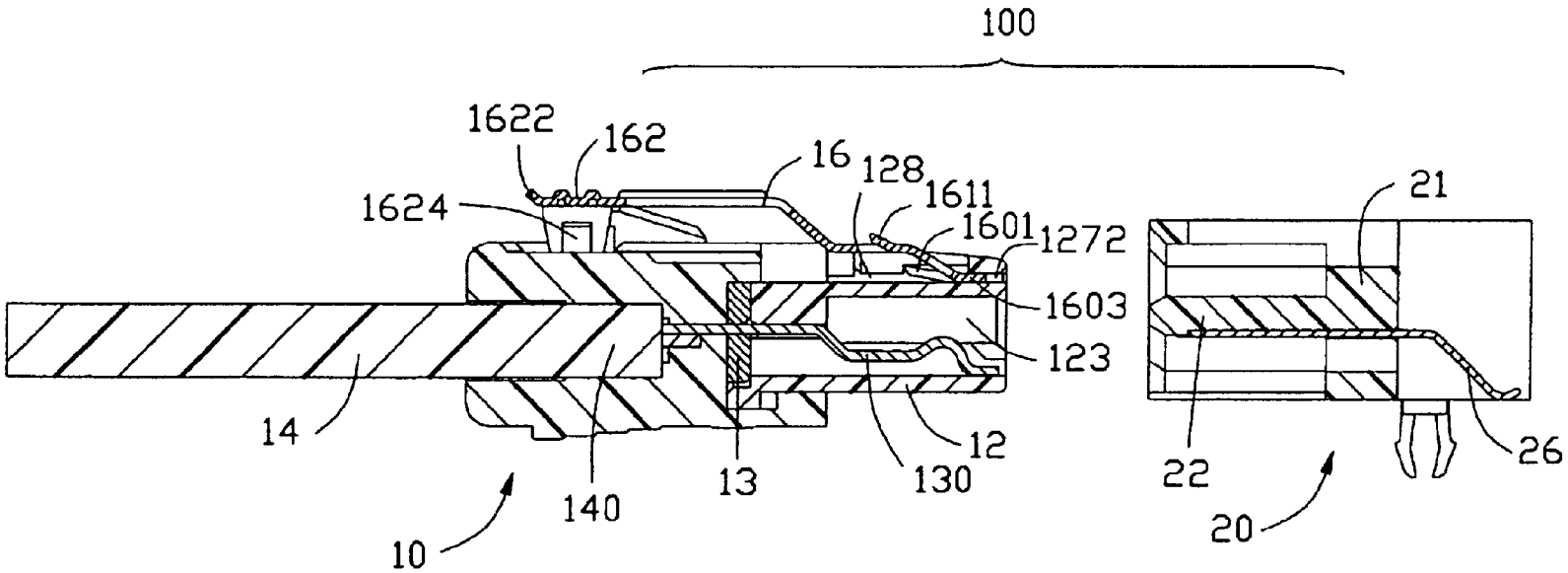
FIG. 8 is a cross-sectional view taken along line 8—8 of FIG. 1.
Figure 9:
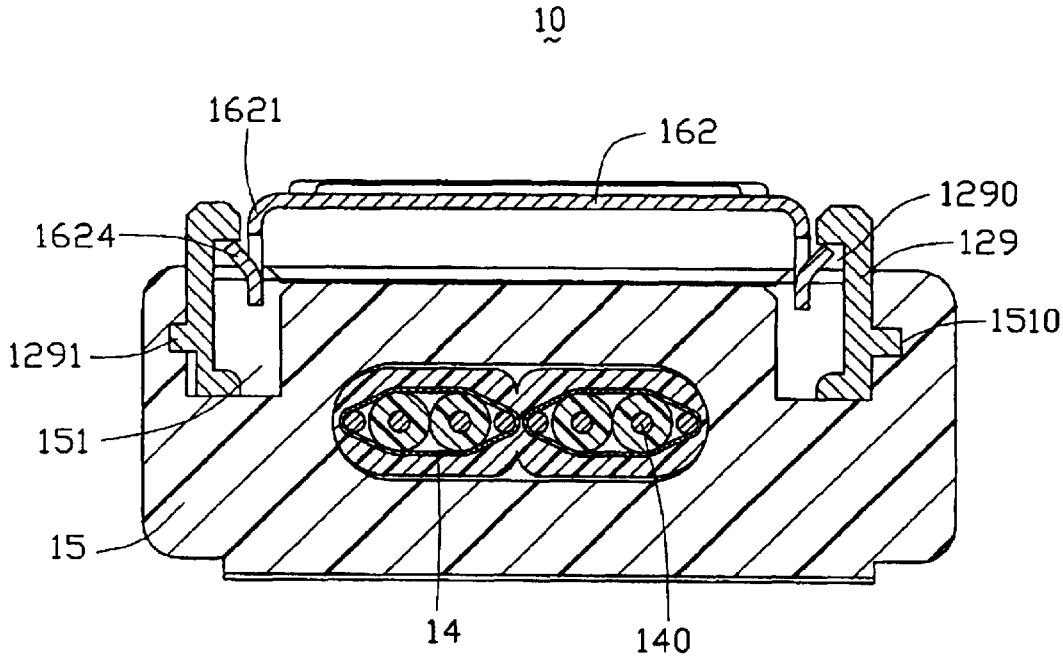
FIG. 9 is a cross-sectional view taken along 9—9 of FIG. 11.

Referring to FIGS. 1 and 2 in conjunction with FIGS. 6–8, the complementary connector 20 comprises a base portion 21, a tongue portion 22 extending forwardly from a middle portion of the base portion 21, a pair of arm portions 23 extending from opposite ends of the base portion 21 in a mating direction of the complementary connector 20, and a protect portion 24 extending forwardly from an upper portion of the base portion 21 and connecting with upper sides of the pair of the arm portions 23. The arm portions 23 and the protect portion 24 define a mating space 25 therebetween. A plurality of terminals 26 are received in the tongue portion 22 and each terminal 26 has a tail portion extending beyond a rear face of the base portion 21 for connecting to a printed circuit board (not shown) on which the complementary connector 20 is mounted. The protect portion 24 defines a pair of engaging openings 27 extending therealong and communicating with the mating space 25.

Figure 10:
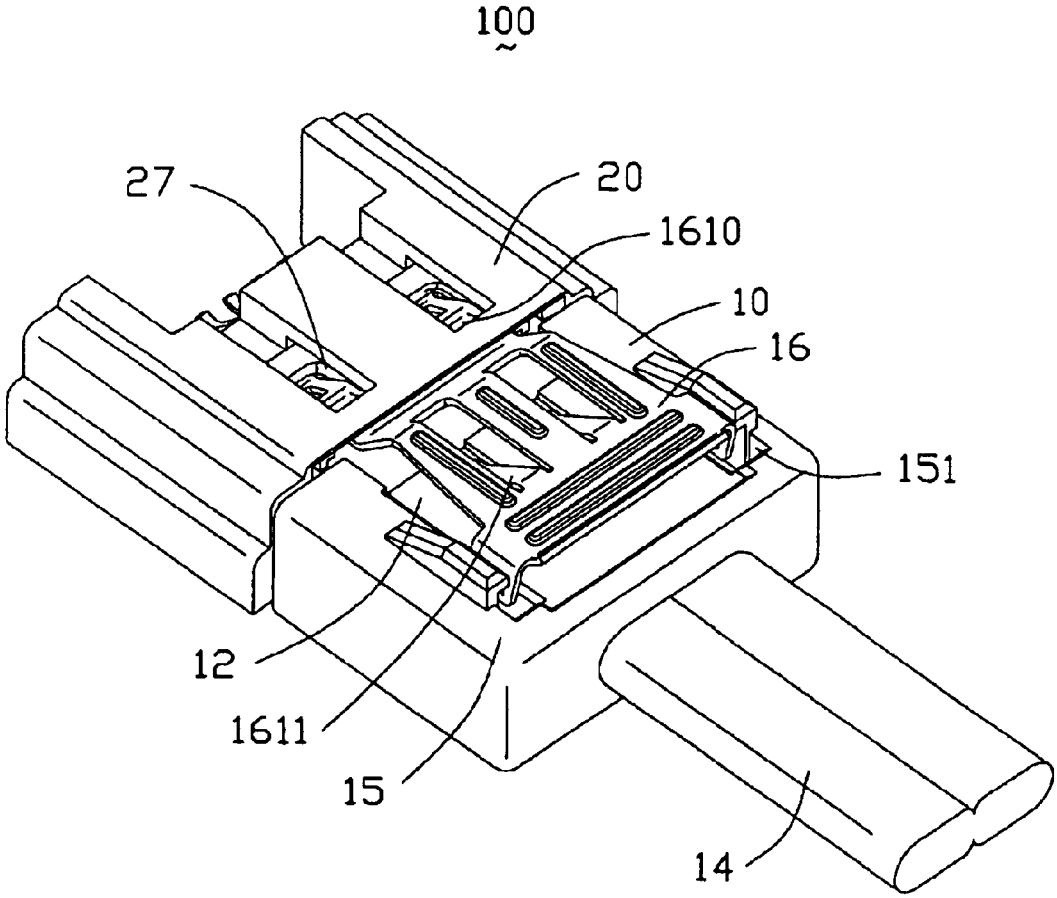
FIG. 10 is an assembled view of the cable end connector assembly and the complementary connector of FIG. 2.
Figure 11:
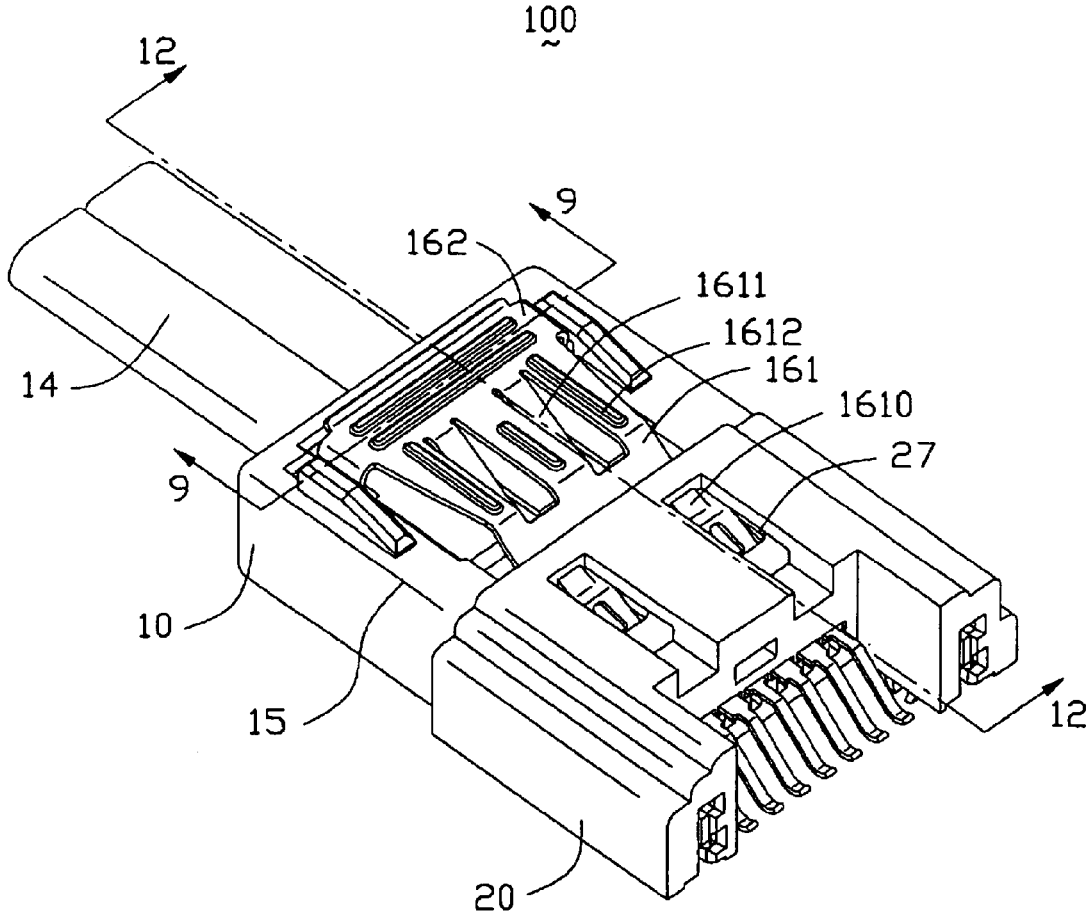
FIG. 11 is a view similar to FIG. 10, but taken from a different aspect.
Figure 12:
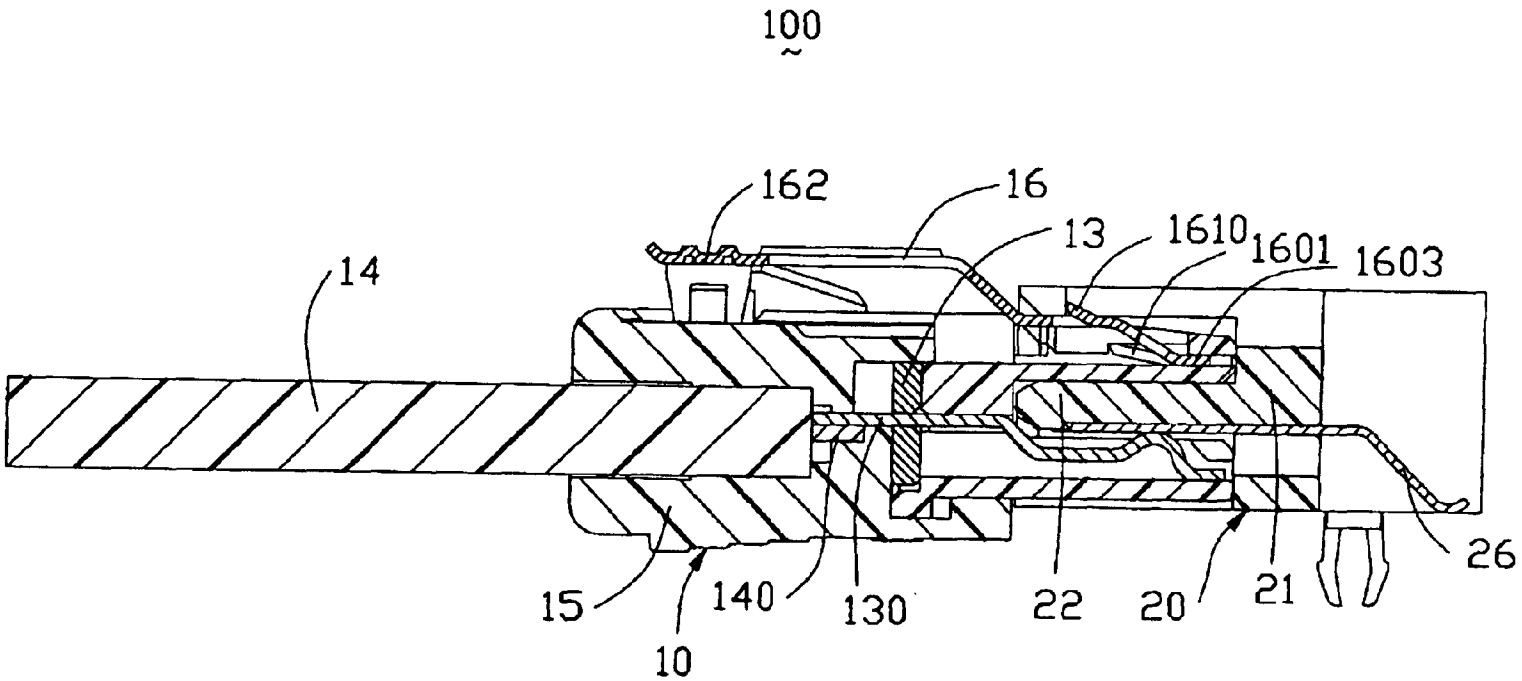
FIG. 12 is a cross-sectional view taken along line 12—12 of FIG. 11.

Referring to FIGS. 10–12, when the cable end connector assembly 10 is to be mated with the complementary connector 20, a pressing force is exerted on the pushing section 162 of the locking member 16 to deflect the lower tabs 1611 of the locking section 161, a front end of the cable end connector assembly 10 is inserted into the mating space 25 of the complementary connector 20 and the tongue portion 22 of the complementary connector 20 is received in the receiving space 123 of the cable end connector assembly 10. At the same time, the terminals 26 of the complementary connector 20 electrically connect with the contacts 130 of the cable end connector assembly 10. Once the pressing force is released, the locking section 161 and the lower tabs 1611 restore to their original configurations due to their own elasticity. The latch portions 1610 of the locking member 16 are locked in the corresponding engaging openings 27, thereby establishing a reliable engagement between the cable end connector assembly 10 and the complementary connector 20. When the cable end connector assembly 10 is to be disengaged from the complementary connector 20, a contrary operating procedure is applied.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly for mating with a complementary connector, comprising:

an insulative housing comprising a pair of wing portions extending rearwardly from a rear end thereof;

a plurality of contacts received in the insulative housing;

a cable comprising a plurality of conductors electrically connecting with corresponding contacts;

a cover enclosing the rear end of the insulative housing and defining a pair of passages, said wing portions of the insulative housing respectively received in the passages; and a locking member comprising at a front end thereof a retaining section secured with the insulative housing, a pushing section at a rear end thereof engaged with the pair of wing portions of the insulative housing, and at least one latch portion located on the front end thereof close to the retaining section and adapted for locking with the complementary connector; wherein the pushing section of the locking member comprises a flat body portion and a pair of side beams extending downwardly from the body portion, and wherein the wing portion of the insulative housing defines a cutout to receive the side beam of the locking member and allow the side beam a restricted up and down movement.

2. The cable end connector assembly as claimed in claim 1, wherein the side beam forms a spring tab engaged in the cutout of the wing portion for preventing the pushing section from escaping the cutout.

3. The cable end connector assembly as claimed in claim 1, wherein the cover defines a pair of side channels respectively communicating with the passages, and wherein each wing portion forms a guiding projection received in the side channel of the cover for increasing a retaining force between the cover and the insulative housing.

4. The cable end connector assembly as claimed in claim 1, wherein the insulative housing defines a pair of grooves, and wherein the retaining section of the locking member comprises a pair of bar portions extending from opposite ends thereof and received in the grooves.

5. The cable end connector assembly as claimed in claim 1, wherein the insulative housing defines a slit receiving a middle portion of the retaining portion of the locking member.

6. The cable end connector assembly as claimed in claim 5, wherein the insulative housing defines a first slot communicating with the slit, and wherein the locking member forms a positioning portion extending forwardly from the middle portion of the retaining section and being locked within the first slot.

7. The cable end connector assembly as claimed in claim 5, wherein the insulative housing defines a second slot communicating with the slit, and wherein the locking member comprises a snap portion extending rearwardly from the middle portion of the retaining section and being locked within the second slot.

8. The cable end connector assembly as claimed in claim 1, wherein the cover defines a channel therein, and wherein the locking member comprises a lower tab received in the channel and resiliently abutting against a bottom surface of the channel.

9. The cable end connector assembly as claimed in claim 1, wherein the body portion of the pushing section is formed with a plurality of ribs.

10. An electrical connector assembly comprising:

an insulative housing;

a plurality of contacts disposed in the housing;

a cover bound to said housing;

a pair of wing portions formed on one of said housing and said cover, and exposed to an exterior in a vertical direction; and a locking member attached to at least one of said housing and said cover, said locking member defining about a rear end thereof a pushing section with a pair of side beams thereof and a latch portion about a front end thereof; wherein said pair of side beams are up and down moveably hidden between said pair of wing portions, and protectively unexposed to the exterior laterally.

11. The connector assembly as claimed in claim 10, wherein said pair of side beam includes means vertically engageable with said pair of wing portions.

12. The connector assembly as claimed in claim 10, wherein a cable includes a plurality of conductors connected to the corresponding contacts and enclosed in said cover.

13. The connector assembly as claimed in claim 10, wherein said pair of wing portions are formed on the housing, and said cover defines a pair of passages receiving said pair of wing portions, respectively.

14. An electrical connector assembly comprising:

an insulative housing;

a plurality of contacts disposed in the housing;

a cover bound to said housing;

a pair of passages formed in one of said housing and said cover, and communicating with an exterior in a vertical direction; and a locking member attached to at least one of said housing and said cover, said locking member defining about a rear end thereof a pushing section with a pair of side beams thereof and a latch portion about a front end thereof; wherein said pair of side beams are up and down moveably hidden within said pair of passages, respectively, and protectively unexposed to the exterior laterally.

15. The connector assembly as claimed in claim 14, wherein a cable includes a plurality of conductors connected to the corresponding contacts and enclosed in said cover.

16. The connector assembly as claimed in claim 14, wherein said pair of passages are formed in the cover.

* * * * *